US007610922B2

(12) United States Patent
Marone et al.

(10) Patent No.: US 7,610,922 B2
(45) Date of Patent: Nov. 3, 2009

(54) DEVICE FOR THE METERED DELIVERY OF A LIQUID WASHING OR RINSING AGENT, FOR A WASHING MACHINE

(75) Inventors: Giuseppe Marone, Moncalieri (IT); Paolo Da Pont, Turin (IT)

(73) Assignee: Elbi International S.p.A., Turin (IT)

( * ) Notice: Subject to any disclaimer, the term of this patent is extended or adjusted under 35 U.S.C. 154(b) by 379 days.

(21) Appl. No.: 11/006,771

(22) Filed: Dec. 8, 2004

(65) Prior Publication Data

US 2005/0150260 A1 Jul. 14, 2005

(30) Foreign Application Priority Data

Dec. 9, 2003 (IT) ..... T003A0986

(51) Int. Cl.
*B08B 3/00* (2006.01)

(52) U.S. Cl. ..... 134/99.2; 134/94.1; 134/58 D; 134/57 D

(58) Field of Classification Search ..... 134/94.1, 134/99.2, 57 D, 58 D
See application file for complete search history.

(56) References Cited

U.S. PATENT DOCUMENTS 4,190,181 A * 2/1980 Arnaud ..... 222/456
5,335,622 A * 8/1994 Say ..... 116/227
5,839,454 A * 11/1998 Matz ..... 134/57 D
6,138,693 A * 10/2000 Matz ..... 134/57 D
6,694,990 B2 * 2/2004 Spanyer et al. ..... 134/57 D

FOREIGN PATENT DOCUMENTS

DE 10028630 A1 * 12/2000

* cited by examiner

*Primary Examiner*—Michael Barr
*Assistant Examiner*—Jason Heckert
(74) *Attorney, Agent, or Firm*—Sughrue Mion, PLLC

(57) ABSTRACT

A device for the metered delivery of a liquid washing or ringing agent for a washing machine and the like. The device includes a casing which is to be secured to the machine and which is provided with a refillable reservoir for the liquid agent in which is defined a delivery receptacle capable of holding an amount of liquid agent corresponding to a plurality of metered amounts, and an electrically controlled delivery valve device associated with the receptacle and capable of permitting a flow of liquid agent from the delivery receptacle towards the washing chamber of the machine, a level-indicator device associated with the delivery receptacle and capable of signalling the instantaneous level reached by the rinsing agent in the receptacle, and a control unit connected to the indicator and arranged to control the delivery valve device in accordance with predetermined modalities as a function of the signal provided by the level-indicator device.

3 Claims, 2 Drawing Sheets

DEVICE FOR THE METERED DELIVERY OF A LIQUID WASHING OR RINSING AGENT, FOR A WASHING MACHINE

BACKGROUND OF THE INVENTION

The present invention relates to a device for the metered delivery of a liquid washing or rinsing agent, for a washing machine, such as a laundry-washing machine or a dish-washing machine.

More specifically, the invention relates to a delivery device comprising

- a casing which is to be secured to the machine and in which are provided
- a refillable receptacle for the liquid agent, which receptacle is capable of containing an amount of the agent corresponding to a plurality of metered amounts, and
- an electrically controlled delivery valve device associated with an opening in the receptacle and capable of permitting a flow of liquid agent from the delivery receptacle towards the washing chamber of the machine.

Devices for the delivery of rinsing agents for dish-washing machines are known in which a level-indicator device is provided in a refillable reservoir and is capable, when the door of the dish-washing machine is open, of providing a signal indicating the level reached by the rinsing agent in the reservoir, that signal being usable to generate an indication of the need to refill the reservoir. In the course of an operating cycle of the machine, an amount of liquid rinsing agent is delivered by activating an electromagnetic delivery valve device associated with a delivery receptacle which, when the door is closed, is in the uppermost portion of the above-mentioned reservoir. The repeated excitation of the delivery valve device enables the total amount of rinsing agent delivered to be varied, for example, as a function of the detected hardness of the water fed into the machine for the rinsing operation. The repeated activation of the valve device involves the generation of an irritating noise, in particular if this device operates with alternating current. With direct current electromagnetic valve devices it is possible to mitigate this disadvantage but the use of direct current devices involves recourse to rectifier circuits, which is unfavourable from the point of view of costs.

SUMMARY OF THE INVENTION

An object of the present invention is to provide an improved innovative device for the metered delivery of a liquid washing or rinsing agent to a washing machine, such as a laundry-washing machine or a dish-washing machine.

That and other objects are achieved in accordance with the invention with a delivery device of the type specified above, characterized in that it also comprises

- a level-indicator device associated with the above-mentioned delivery receptacle and capable of signalling the instantaneous level reached by the liquid agent in the receptacle, and
- control means connected to the indicator and arranged to control the above-mentioned delivery valve device in accordance with predetermined modalities, as a function of the signal provided by the level-indicator device.

According to a further feature, the above-mentioned control means can advantageously be arranged to control the activation of a signalling device, for example, of the optical or acoustic type, when the level-indicator device signals a level of liquid agent lower than a predetermined value in the above-mentioned delivery receptacle.

Other features and advantages of the invention will emerge from the following detailed description which is given purely by way of non-limiting example with reference to the appended drawings in which:

DETAILED DESCRIPTION OF THE INVENTION

Figure 1:
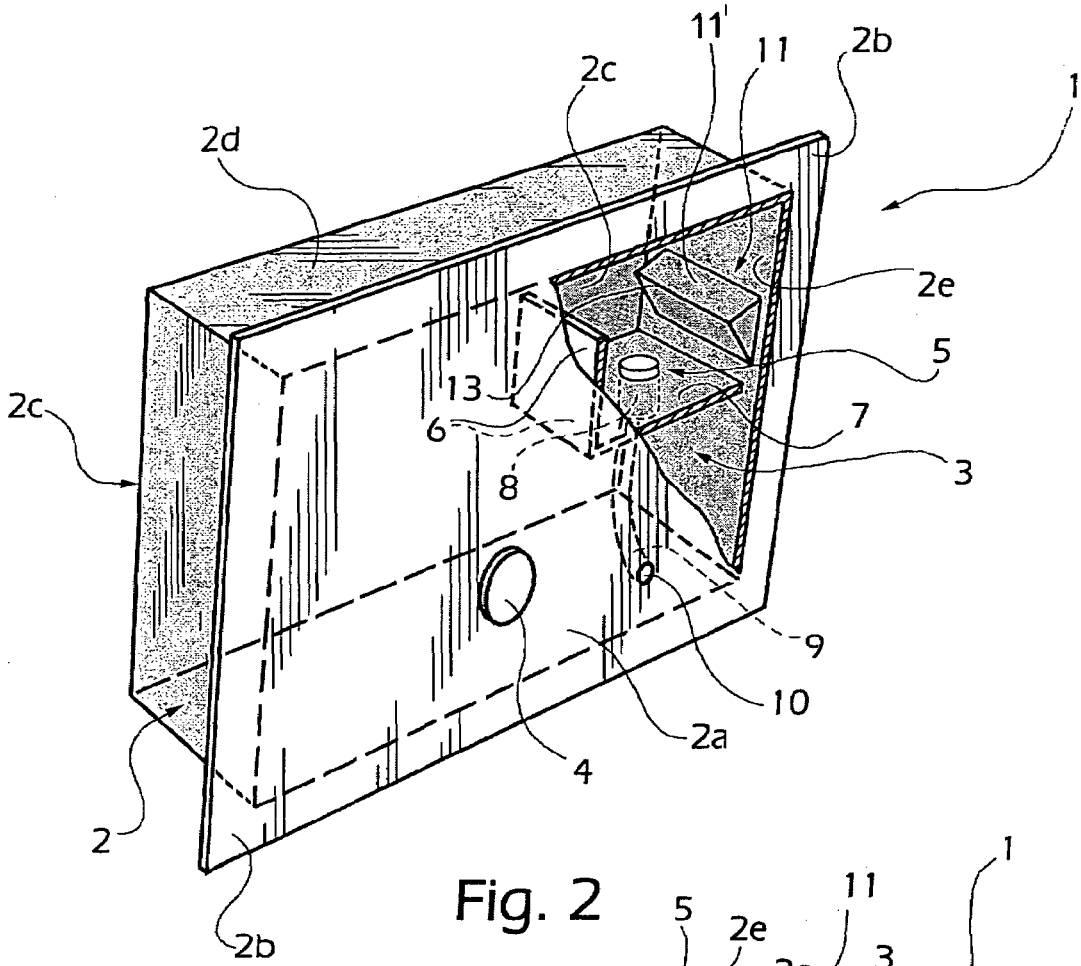
FIG. 1 is a partially sectioned perspective view of a device in accordance with the invention for a dish-washing machine having a front door, the device being shown in the position assumed when the door of the dish-washing machine is closed.

In the drawings, 1 generally indicates a device in accordance with the invention for the controlled delivery of a liquid rinsing agent to a dish-washing machine which, in a manner known per se, is provided with a door for access to a washing chamber, which door is pivotable between a substantially vertical closed position and a substantially horizontal loading position.

Figure 2:
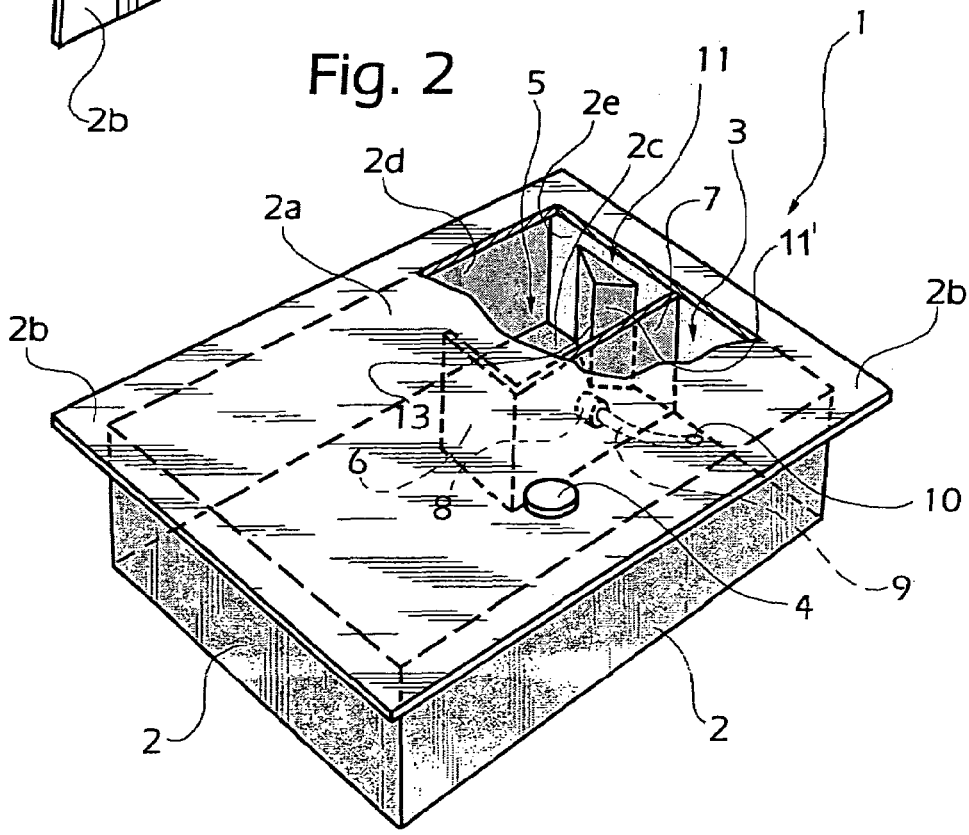
FIG. 2 shows the device of FIG. 1 in the position assumed when the door of the dish-washing machine is open.

The device 1 comprises a casing 2 which, in the embodiment illustrated by way of example, is substantially parallel-epi-pedal. The casing has a main front face 2*a* which is to face the washing chamber of the machine and which has a peripheral frame 2*b* which is to be fitted against the internal surface of the door (FIGS. 1 and 2).

A refillable main chamber or reservoir, indicated 3, which is to contain an amount of liquid rinsing agent usable in the course of a plurality of successive operating cycles of the dish-washing machine, is defined in the casing 2 of the delivery device.

The reservoir 3 is refillable through an opening which is advantageously arranged in the front face 2*a* of the casing and with which a removable closing plug 4 is associated.

A delivery receptacle 5 delimited between a pair of walls 6 and 7 is defined in the reservoir 3.

Figure 3:
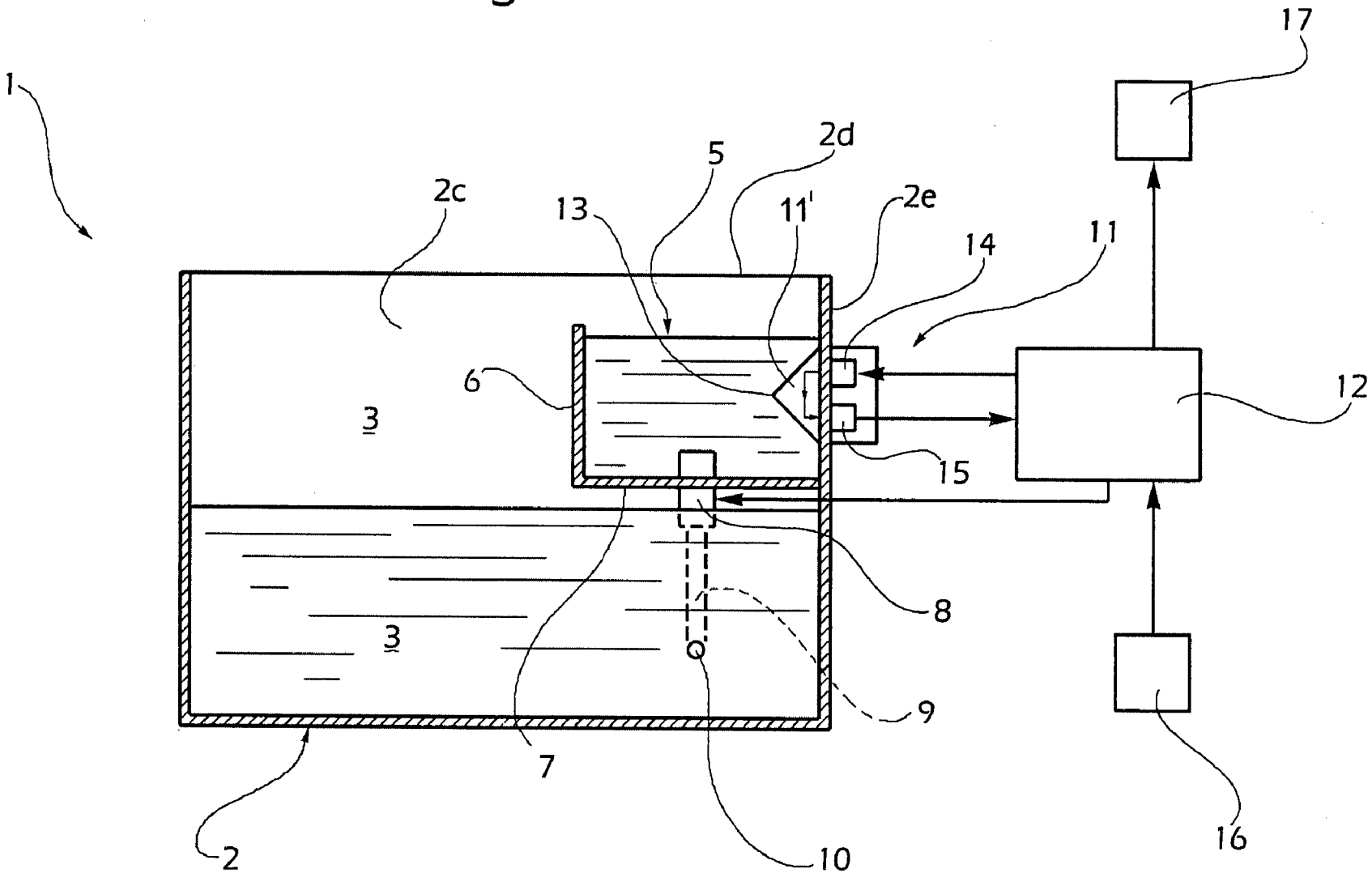
FIG. 3 is a schematic representation of the delivery device according to the previous Figures and of devices connected thereto.

Referring to FIGS. 1 and 3, in the embodiment illustrated, the wall 6 extends substantially between the front wall 2*a* and the facing rear wall 2*c* of the casing, from an intermediate level of the internal region 3 of the casing 2, to a specific distance from the top wall 2*d* of the said casing. The wall 7 likewise extends between the two facing walls 2*a* and 2*c*, between the wall 6 and a lateral wall 2*d* of the casing 2.

When the door of the dish-washing machine is placed in the substantially horizontal, prone, open position, the device 1 is in the position illustrated in FIG. 2. In that condition, the region between the walls 6 and 7 and the base wall 2*c* is in hydraulic communication with the remaining (and predominant) volume of the reservoir 3, by way of the passage defined between the free end of the wall 6 and the wall 2*d* of the casing 2.

If an amount of liquid rinsing agent has been introduced into the reservoir 3, when the door of the dish-washing machine is reclosed, an amount of this rinsing agent corresponding to a plurality of metered amounts is received and held in the receptacle 5, as illustrated in FIG. 3.

In the embodiment illustrated, an opening is defined in the wall 7 of the receptacle 5 and is associated with an electrically controlled delivery valve device 8 of a type known per se. When this device is excited, it brings the overlying region of the receptacle 5 into communication with a delivery duct 9 which leads to an opening 10 located in the front face 2*a* of the device.

A level-indicator device generally indicated 11 is associated with the delivery receptacle 5. When the door of the dish-washing machine is closed, this device is capable of signalling the instantaneous level reached by the rinsing agent in the receptacle 5, for example, to an electronic control unit 12 (FIG. 3).

In the illustrated embodiment, the level-indicator device 11 comprises a substantially dihedral transparent formation 11' which projects into the receptacle 5 from the lateral wall 2*e* of the casing 2. This dihedral formation has a ridge 13 substantially parallel with the wall 7 of the receptacle 5.

As shown schematically in FIG. 3, a radiation emitter 14 and an associated radiation receiver 15, which are connected to the control unit 12, are associated with the dihedral formation 11'.

The arrangement is such that, when the level of rinsing agent in the delivery receptacle 5 is higher than a predetermined level, the radiation emitted by the emitter 14 undergoes almost total reflection at the upper layer or face of the dihedral formation 11', and then a further almost total reflection at the other layer or face of the dihedral formation, and is finally reflected towards the receiver device 15.

When the level of rinsing agent in the delivery receptacle 5 falls, the intensity of the radiation picked up by the receiver device 15 decreases in an almost corresponding manner.

The optical level-indicator device 11 accordingly supplies to the control unit 12 a signal indicating the instantaneous level of the rinsing agent in the delivery receptacle 5, when the door of the dish-washing machine is closed.

The control unit 12 can use the information coming from the level-indicator 11 basically for two purposes, that is, in order to control the opening time of the delivery valve device 8, for the purpose of adjusting, for example, the amount or dose of rinsing or polishing agent delivered as a function of the hardness of the water detected by means of a sensor 16 (FIG. 3) of a type known per se, and/or in order to activate an indicator device 17, for example, of the optical and/or acoustic type, for the purpose of signalling to the user the need to refill the reservoir 3 with rinsing agent.

In the first modality of use of the information coming from the level-indicator 11, the control unit 12 can follow instantaneously the drop in the level of rinsing agent in the receptacle 5 in the course of a delivery.

In the second modality described above, the control unit 12 can detect, each time the door of the dish-washing machine is closed, the level reached by the rinsing agent received and held in the delivery receptacle 5. In fact, as the general level of the rinsing agent falls in the reservoir 3, so does correspondingly the level of rinsing agent which is "trapped" in the delivery receptacle 5 each time the door of the dish-washing machine is reclosed. When this level reaches a predetermined minimum value ("reserve" level), the control unit 12 can advantageously activate the indicator device 17.

Naturally, the principle of the invention remaining the same, the forms of embodiment and details of construction may be varied widely with respect to those described and illustrated purely by way of non-limiting example, without thereby departing from the scope of the invention as defined in the appended claims.

The invention is not intended to be limited in particular to application to dish-washing machines; it can in fact be applied also to washing machines of other types, for example, laundry-washing machines, to which a liquid agent, of which a preliminary quantity is introduced into a receptacle in the most varied forms, for example, in the form of a small tank, etc., has to be delivered in a metered manner. Nor is the invention limited to the particular type of level-indicator illustrated and described above: instead of this device, it is possible to use other devices of a type known per se, such as other level-indicators of the optical type, reed-relay detectors, potentiometer detectors, etc.

What is claimed is:

1. A device for the metered delivery of a liquid rinsing agent to a washing machine provided with a door for access to a washing chamber, which door is pivotable between a substantially vertical closed position and a substantially horizontal loading position;

the device comprising:

a casing which is to be secured to the machine door and in which are provided a refillable reservoir for the rinsing agent and a refillable delivery receptacle which is capable of being brought to a condition of liquid communication with said reservoir only when the door is opened, for receiving an amount of rinsing agent, said delivery receptacle being able to hold an amount of rinsing agent when the door passes to the closed position;

an electrically controlled delivery valve device associated with said delivery receptacle and capable of permitting a flow of rinsing agent from said receptacle towards the washing chamber of the machine;

a level-indicator device associated with the delivery receptacle and capable of signaling the instantaneous level reaches by the rinsing agent in the receptacle when the door is closed; and control means connected to the level-indicator device and configured to control the delivery valve device in accordance with predetermined modalities, as a function of the signals provided by the level-indicator device.

2. A device according to claim 1, wherein the control means are arranged to control the activation of a signaling device when the level-indicator device signals a level of liquid agent lower than a predetermined value in the receptacle.

3. A device according to claim 1, wherein the level-indicator device comprises a dihedral formation which protrudes into the delivery receptacle and with which are associated a radiation emitter device and an associated radiation receiver device, the arrangement being such that, when the level of liquid agent in the delivery receptacle varies within a predetermined range, the radiation picked up in operation by the receiver varies correspondingly.

* * * * *